US007017860B2

(12) United States Patent
Royannais et al.

(10) Patent No.: US 7,017,860 B2
(45) Date of Patent: Mar. 28, 2006

(54) CONTROL AND FIXING DEVICE FOR THE SAIL OF A KITE

(75) Inventors: Arielle Royannais, Biviers (FR); Arnaud Ballu, 2199, Route de Meylan, F-38330, Biviers (FR)

(73) Assignee: Arnaud Ballu, Biviers (FR)

( * ) Notice: Subject to any disclaimer, the term of this patent is extended or adjusted under 35 U.S.C. 154(b) by 0 days.

(21) Appl. No.: 10/505,763

(22) PCT Filed: Jun. 3, 2003

(86) PCT No.: PCT/FR03/01664

§ 371 (c)(1),
(2), (4) Date: Aug. 26, 2004

(87) PCT Pub. No.: WO03/101824

PCT Pub. Date: Dec. 11, 2003

(65) Prior Publication Data

US 2005/0133669 A1 Jun. 23, 2005

(30) Foreign Application Priority Data

Jun. 3, 2002 (FR) ..... 02 06787
Nov. 8, 2002 (FR) ..... 02 13993

(51) Int. Cl.
*B64C 31/36* (2006.01)

(52) U.S. Cl. ..... 244/155 A

(58) Field of Classification Search ..... 244/153 R, 244/154, 155 R, 155 A, 153 A
See application file for complete search history.

(56) References Cited

U.S. PATENT DOCUMENTS

| | | | | | |
|---|---|---|---|---|---|
| 2,472,075 | A * | 6/1949 | Hole | 244/155 A |
| 3,317,165 | A * | 5/1967 | Zobl, III | 244/155 R |
| 3,448,864 | A * | 6/1969 | Fenn et al. | 212/71 |
| 3,920,201 | A * | 11/1975 | Battles | 244/16 |
| 4,015,803 | A * | 4/1977 | Temple | 244/153 R |
| 4,018,408 | A * | 4/1977 | Pearce et al. | 244/153 R |
| 4,026,504 | A * | 5/1977 | Christoffel, Jr. | 244/155 A |
| 4,076,189 | A * | 2/1978 | Powell | 244/153 R |
| 4,286,762 | A * | 9/1981 | Prouty | 244/153 R |
| 4,892,272 | A * | 1/1990 | Hadzicki | 244/153 R |
| 5,213,289 | A * | 5/1993 | Barresi | 244/145 |
| 5,538,204 | A * | 7/1996 | Corbella | 244/153 R |
| 6,003,457 | A * | 12/1999 | Chatelain | 114/39.11 |
| 6,072,245 | A * | 6/2000 | Ockels | 290/55 |
| 6,260,803 | B1 | 7/2001 | Hunts | |
| 6,514,115 | B1 * | 2/2003 | Harich | 446/34 |
| 6,520,454 | B1 * | 2/2003 | Winner | 244/155 A |
| 6,659,031 | B1 * | 12/2003 | Legaignoux | 114/102.1 |
| 6,691,954 | B1 * | 2/2004 | Harrington et al. | 244/155 A |
| 6,745,713 | B1 * | 6/2004 | Starbuck | 114/39.16 |
| 6,830,220 | B1 * | 12/2004 | Runyan | 244/155 A |

(Continued)

FOREIGN PATENT DOCUMENTS

DE 100 47 452 A1 1/2002

(Continued)

*Primary Examiner*—Michael J. Carone
*Assistant Examiner*—S. A. Holzen
(74) *Attorney, Agent, or Firm*—Oliff & Berridge, PLC

(57) ABSTRACT

A control and safety device of a kite wing comprises a stiffening member 11 arranged at each tip of the wing 1 between sliding means 9A, 9B to allow a sliding pre-line 8A to pass through and to maintain a predetermined distance between the front and rear attachments 5A, 5B regardless of the tension applied to the ends of said pre-line.

19 Claims, 7 Drawing Sheets

U.S. PATENT DOCUMENTS

| | | | | |
|---|---|---|---|---|
| 6,869,047 | B1 * | 3/2005 | Pouchkarev | 244/155 A |
| 2002/0185570 | A1 * | 12/2002 | Winner | 244/155 A |
| 2002/0187717 | A1 * | 12/2002 | Harich | 446/61 |
| 2003/0116071 | A1 * | 6/2003 | Starbuck | 114/39.13 |
| 2003/0154898 | A1 * | 8/2003 | Lagaignoux | 114/102.1 |
| 2004/0140393 | A1 * | 7/2004 | Barrs et al. | 244/15 |
| 2004/0195459 | A1 * | 10/2004 | Pouchkarev | 244/153 R |
| 2005/0040291 | A1 * | 2/2005 | Hansel | 244/155 A |
| 2005/0133669 | A1 * | 6/2005 | Royannais et al. | 244/155 A |

FOREIGN PATENT DOCUMENTS

| | | |
|---|---|---|
| WO | WO 02/38440 A1 | 5/2002 |

* cited by examiner

CONTROL AND FIXING DEVICE FOR THE SAIL OF A KITE

BACKGROUND OF THE INVENTION

The present invention relates to a control and safety device for a power kite wing, in particular an inflatable wing, comprising:

- a first pair of front lines connected to front attachments situated at each tip of the leading edge,
- a second pair of rear lines connected to rear attachments arranged at each tip of the trailing edge,
- sliding means fixed to the front and rear attachments for the lines to pass through,
- and a control device operating in conjunction with the front and rear lines to guide the kite.

STATE OF THE ART

Modern arch-shape power kites are usually provided with four control lines, two front and two rear, connected to the four corners of the kite and enabling a turning action and a pitching action. When the kite falls into the water, the configuration is very often recurrent—lines stretched to the leeward of the pilot, kite resting on its front (leading edge) and stuck in this position without being able to be re-launched. The distance separating the front and rear attachments on the tips of the wing does not in fact produce enough leverage to allow a desirable re-launch to be performed directly in reverse. To obtain sufficient leverage, it would have to be possible to exert a traction effect on the rear of the wing (trailing edge) at a location where the latter is much wider than at the level of its attachments. It is known to add an additional control line for this purpose. Nevertheless, it is desirable to simplify these control devices as far as possible to avoid risks of tangling in particular.

It is also known to achieve reverse re-launch systems of these inflatable power kite wings without an additional line. For example by connecting the rear lines to the front lines (which support most of the traction forces) by means of a pulley situated at the location of the rear attachment. A connection then connects this rear line to the trailing edge of the wing, at a location that is sufficiently wide to exert the required leverage. By this arrangement, any force exerted on the front lines prevents sliding of the rear lines at the level of their attachments to the front lines. Any slackening of the front lines makes it possible to exert a tractive force on the rear lines, and therefore directly on the trailing edge.

Nevertheless, such a device disturbs control of the wing, may cause tangling due to the additional lines floating between the front and rear lines, and needs to be integrated directly at the manufacturing stage. In addition, when a strong traction is exerted on the rear lines, movement of the front/rear attachments of the wing towards one another may appreciably disturb the shape of the wing and have adverse effects on its aerodynamics.

The document WO 02/38440 describes a kite control device wherein each wing tip comprises a front line fixedly connected to the front part, a pulley attached to the rear part and operating in conjunction with the rear line, which line is connected to an intermediate connection of the front line. A re-launch line is fixed between the rear line and a bridle situated on the trailing edge of the wing. Such a control device requires a first main front line fixedly connected to the front corner of the wing, and a control line return.

OBJECT OF THE INVENTION

The object of the present invention is to achieve a reverse gear re-launch control device, in particular for an inflatable kite wing, of simple structure, preventing any risk of tangling, and without disturbing the control and profile of the wing.

The control and safety device is characterized in that a stiffening member is arranged at each tip of the wing between the sliding means to allow a sliding pre-line to pass through and to maintain a predetermined distance between the front and rear attachments regardless of the tension applied to the ends of said pre-line.

The sliding pre-line is confined by a front connection and an intermediate connection forming stops with the sliding means when a tractive force is applied in one direction or the other. A re-launch line is securedly fixed to the sliding pre-line being connected to at least one slat on the trailing edge side and to the rear line. The sliding means of the pre-line can be formed by links fixed to the front and rear attachments.

The control device comprises a control bar connected to the rear lines and a cast-off device comprising actuating means associated with a pull-ring connected to the front lines. The actuating means advantageously comprise a connecting cord for connection to an attachment loop, and a tubular sleeve whereon there is coaxially mounted an actuating ring which comprises at least one gripping means in connection with a rear line connected to the control bar. Such a device enables movement of the control bar in translation and rotation with respect to the cord passing through the sleeve. The cord comprises a securing pin for keeping the pull-ring in the engaged position, and a flexible stop disk designed to both keep the sleeve in the engaged position during normal use of the kite and to enable the pin to be removed by movement of the sleeve to the disengaged position following translation of the gripping means.

DESCRIPTION OF A PREFERRED EMBODIMENT

Figure 1:
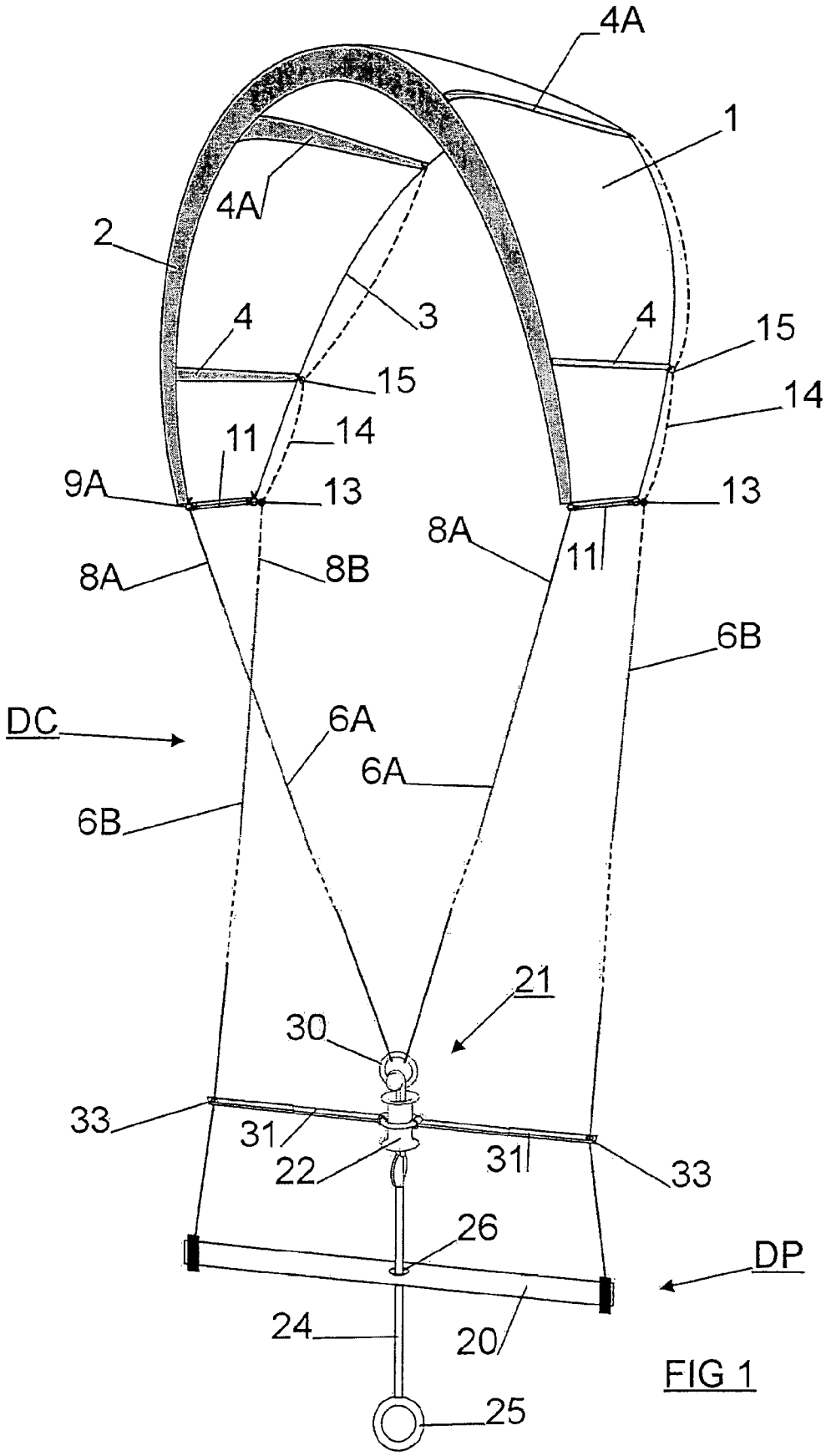
FIG. 1 is a schematic view of the wing of a kite equipped with the control and safety device according to the invention.
Figure 2:
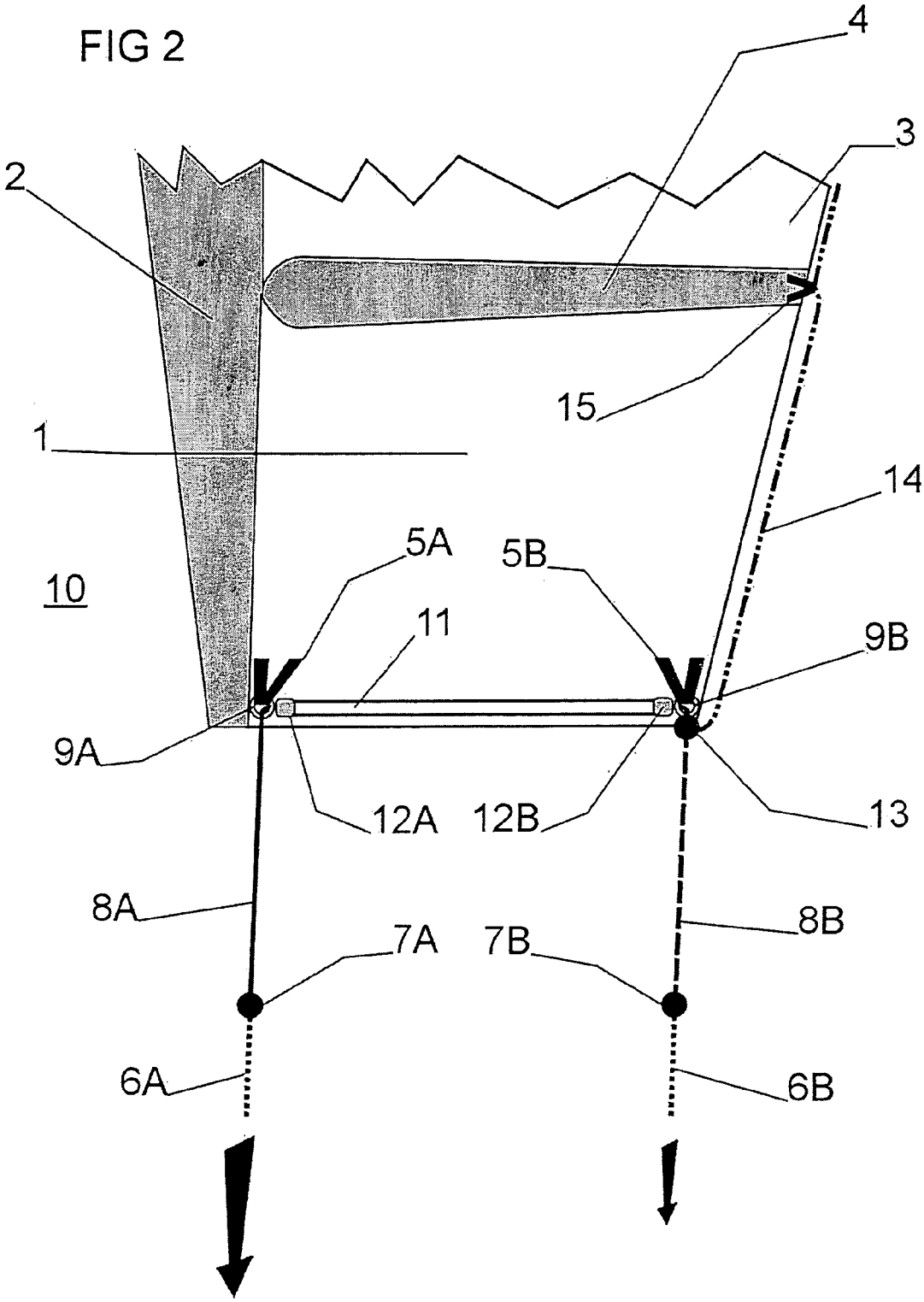
FIG. 2 shows an enlarged scale view of a wing tip in flight configuration.
Figure 3:
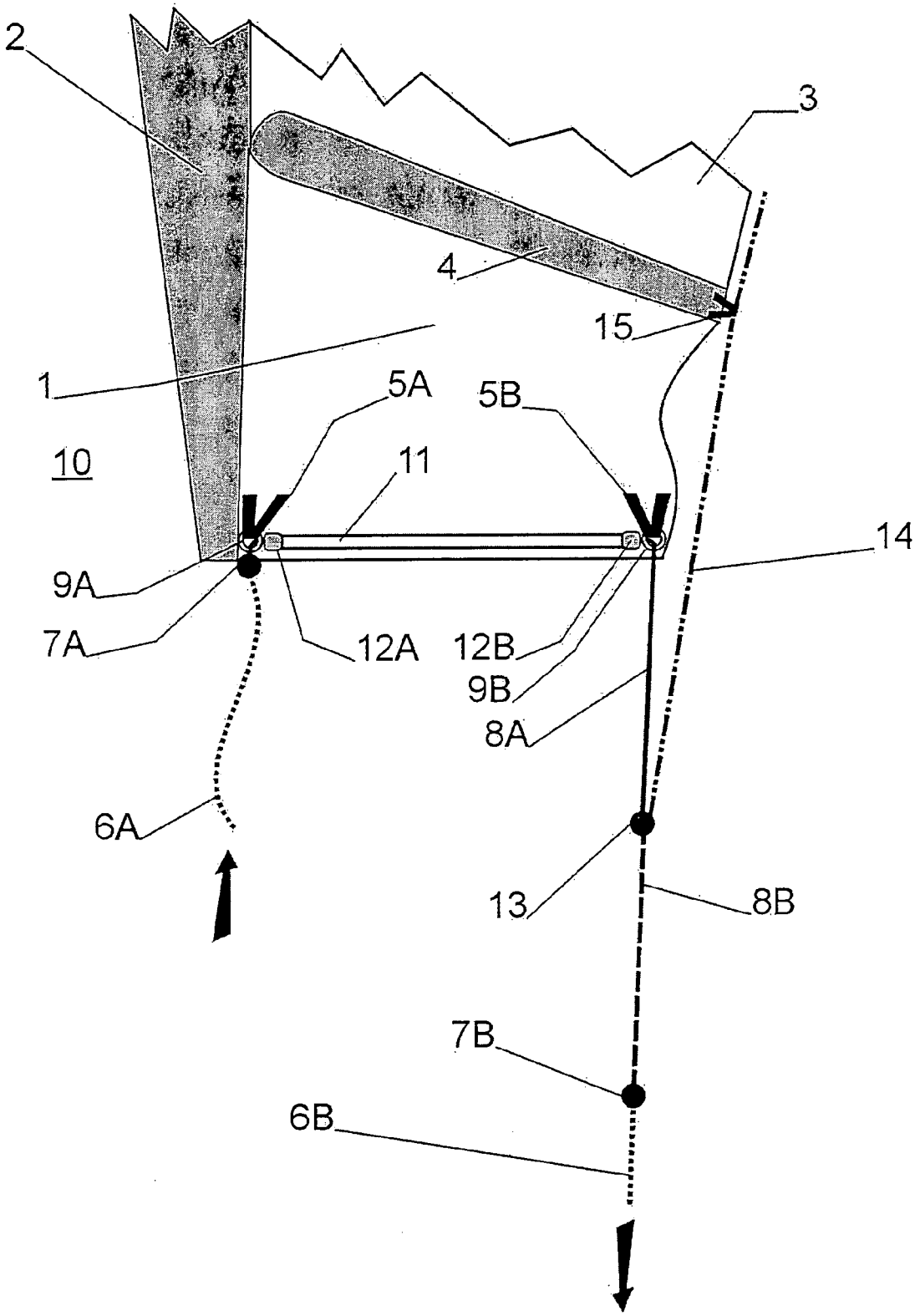
FIG. 3 is an identical view to FIG. 2, representing the wing in the reverse re-launch state with the leading edge resting on the water.

With reference to FIGS. 1 to 3, the control and safety device DC of a kite wing 1, in particular an inflatable wing, comprises a first pair of front lines 6A, a second pair of rear lines 6B, front attachments 5A and rear attachments 5B, and a control device DP. Each of the two right and left tips of the wing 1 is connected to a front line 6A and to a rear line 6B. The substantially arch-shaped wing 1 is thus equipped with two front lines 6A arranged at the two front tips of the leading edge 2 and with two rear lines 6B arranged at the two rear tips of the trailing edge 3. Only one half of the present device at one of the tips 10 of the wing 1 will henceforth be described in the embodiment of FIGS. 2 and 3. The two sides of the wing 1 are in fact symmetrical and the control device DC that is connected thereto is identical on each side.

A sliding pre-line 8A runs successively through a link 9A of a front attachment 5A, a stiffening member 11 and a link 9B of a rear attachment 5B. The presence of the stiffening member 11 enables a predetermined distance to be maintained between the attachments 5A, 5B on each side of the wing 1 whatever the tension applied to the ends of the pre-line 8A.

A front line 6A is connected to a sliding pre-line 8A by means of a front connection 7A. The front attachment 5A and rear attachment 5B are arranged at the respective front and rear tips of the wing 1. The front attachment 5A is arranged on the leading edge 2 side and the rear attachment 5B is arranged on the trailing edge 3 side. The links 9A and 9B are respectively connected to the front attachment 5A and rear attachment 5B. These links can be formed by other sliding means, in particular metal rings, shackles or quick links.

The stiffening member 11 arranged between the two attachments 5A, 5B is formed in particular by a resistant hollow tube having a length corresponding substantially to the distance between the front attachment 5A and rear attachment 5B. The sliding pre-line 8A runs through the hollow stiffening member 11 which comprises at its ends two end-pieces 12A and 12B designed to the increase the mechanical strength. The end-pieces 12A and 12B are dimensioned to act as stops with the respective links 9A or 9B.

The sliding pre-line 8A is therefore able to slide successively through the link 9A, the end-piece 12A of the stiffening member 11, the end-piece 12B, and the link 9B, and is terminated by a second connection 13. The front connection 7A and intermediate connection 13 are dimensioned in such a way as not to be able to pass through the links 9A or 9B. When the lines of the device DC become taut due to the kite flying, most of the forces are exerted on the two front lines 6A. The intermediate connection 13 thus comes up against the stop formed by the link 9B (FIG. 2).

The sliding pre-line 8A generates compression forces between the two links 9A/9B, which are kept apart by means of the stiffening member 11 wherethrough the pre-line 8A runs. The profile of the wing 1 is not stressed in flexion in this area, regardless of the reaction forces in presence. Any arching effect under load is thus prevented.

A re-launch line 14 is fixedly attached to the sliding pre-line 8A, substantially at the level of the intermediate connection 13. At its distal end, the re-launch line 14 is secured to a slat 4 on the trailing edge 3 side of the wing 1 by means of a connection 15. Thus, any traction exerted on the pre-line 8B and enabled by releasing of the sliding pre-line 8A is transmitted to the re-launch line 14.

When after a fall the kite is resting with its leading edge 2 against the surface of the water, a traction exerted directly on the rear of the wing 1 enables the latter to be re-launched in reverse and turned, as the width of the kite at the location of the slat 4 is greater than that located between the attachments 5A and 5B. The leverage is sufficient to perform this re-launch operation. The presence of the pre-line 8B between the connections 13 and 7B enables length adjustments to be made to balance the two sides of the wing 1. It is clear that the rear line 6B could thus be directly connected to the connection 13 of the rear re-launch line 14.

When the kite is in flight, any traction exerted on the pre-line 8B by means of the rear line 6B and rear connection 7B causes a modification of the trim of the kite on the side where the pilot performs this manoeuvre. Indeed, as the traction forces are mainly exerted on the front lines 6A, the connection 13 remains jammed against the link 9B. The rear line 6B acts as if it was operating directly connected to its rear attachment 5B as on a conventional configuration.

The separating distance given by the manufacturer between the two front and rear attachments 5A/5B is conditioned solely by the qualities of flight and piloting he wants to give the kite, and can not be imposed by the leverage required for rear re-launching of the kite. It is the major advantage of the embodiment according to the present invention to combine the advantage of ordinary control with that of a rear re-launching device.

Another advantage of the present device concerns safety. Kites do in fact generate fierce accelerations which may be difficult to control, or may even cause a loss of control by the pilot when the kite picks up too much speed. A sharp instantaneous pull on the trailing edge 3 breaks the speed, thereby stopping the uncontrolled pull of the kite. In a configuration of the prior art, this action is not possible as the maximum amplitude of traction on the rear lines 6B is limited by the distance separating the front and rear attachments 5A and 5B, and leaves the kite in a maximum power configuration. According to the embodiment of FIGS. 2 and 3, it is the initial length of the front line 6A that determines the maximum traction able to be exerted directly on the connection 15 at the rear of a slat 4. Thus, by connecting several slats 4 by means of respective connections 15 and a re-launch line 14, it is possible to reclose the circular trailing edge 3 completely on itself thus causing the flight of the kite to be instantaneously stopped and keeping the kite at ground level after the latter has fallen.

In FIG. 1, the rear re-launch line 14 is advantageously arranged sliding through a fixing 15 of the slat 4 closest to the end 10 of the wing 1 and is then secured to the fixing of the end of the next slat 4A. Any mobilisation of the re-launch line 14 will thus first have an effect on the end fixing of the front slat before progressively closing the other slat ends towards the inside of the wing 1 due to its lobe shape.

The piloting control device DP comprises a straight control bar 20 connected at the ends thereof to the two rear lines 6B, and a rotating cast-off device 21 connected to the two front lines 6A.

Figure 4:
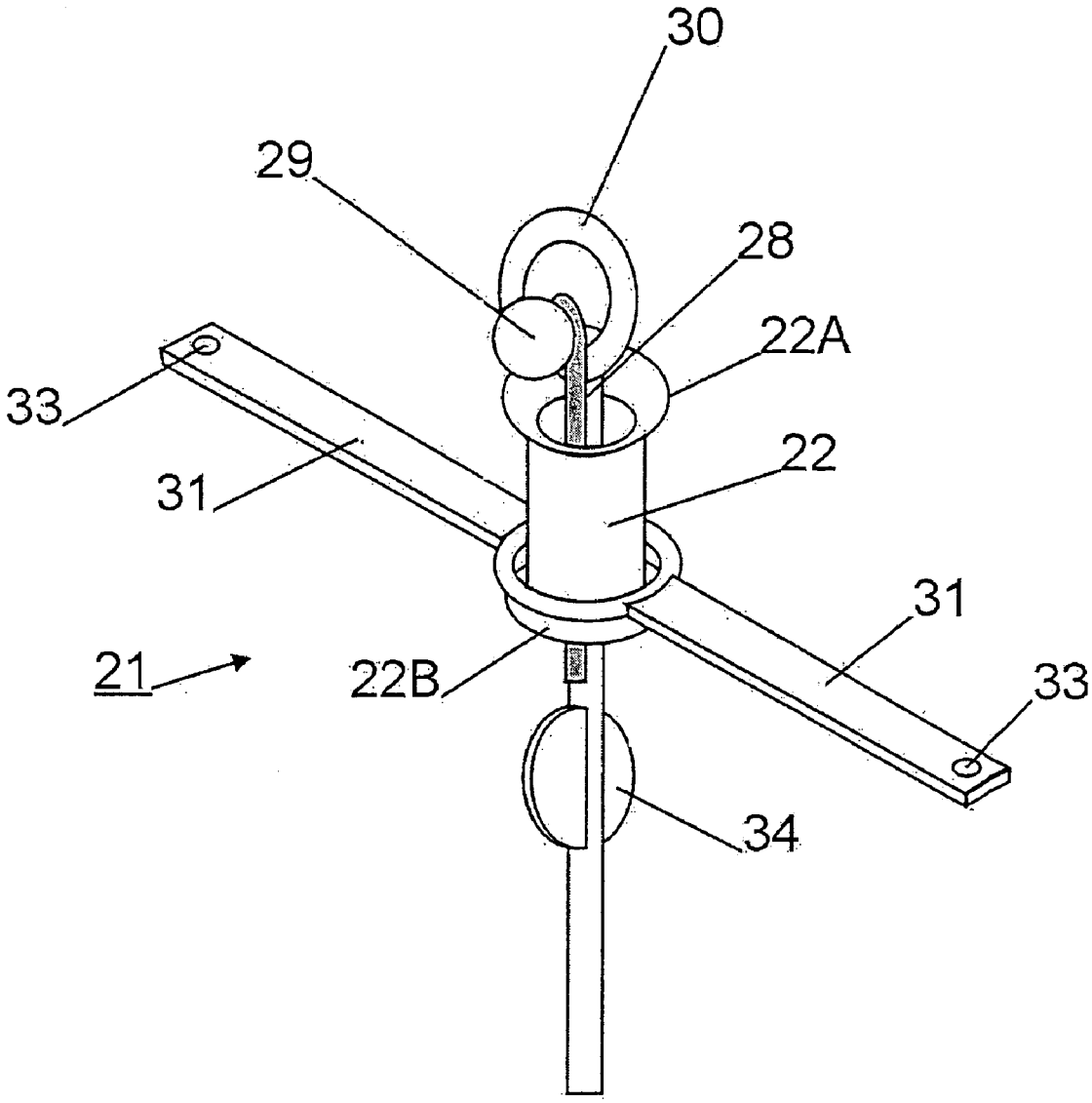
FIGS. 4 and 5 are perspective views of the cast-off device, respectively in the engaged and in the disengaged position.
Figure 5:
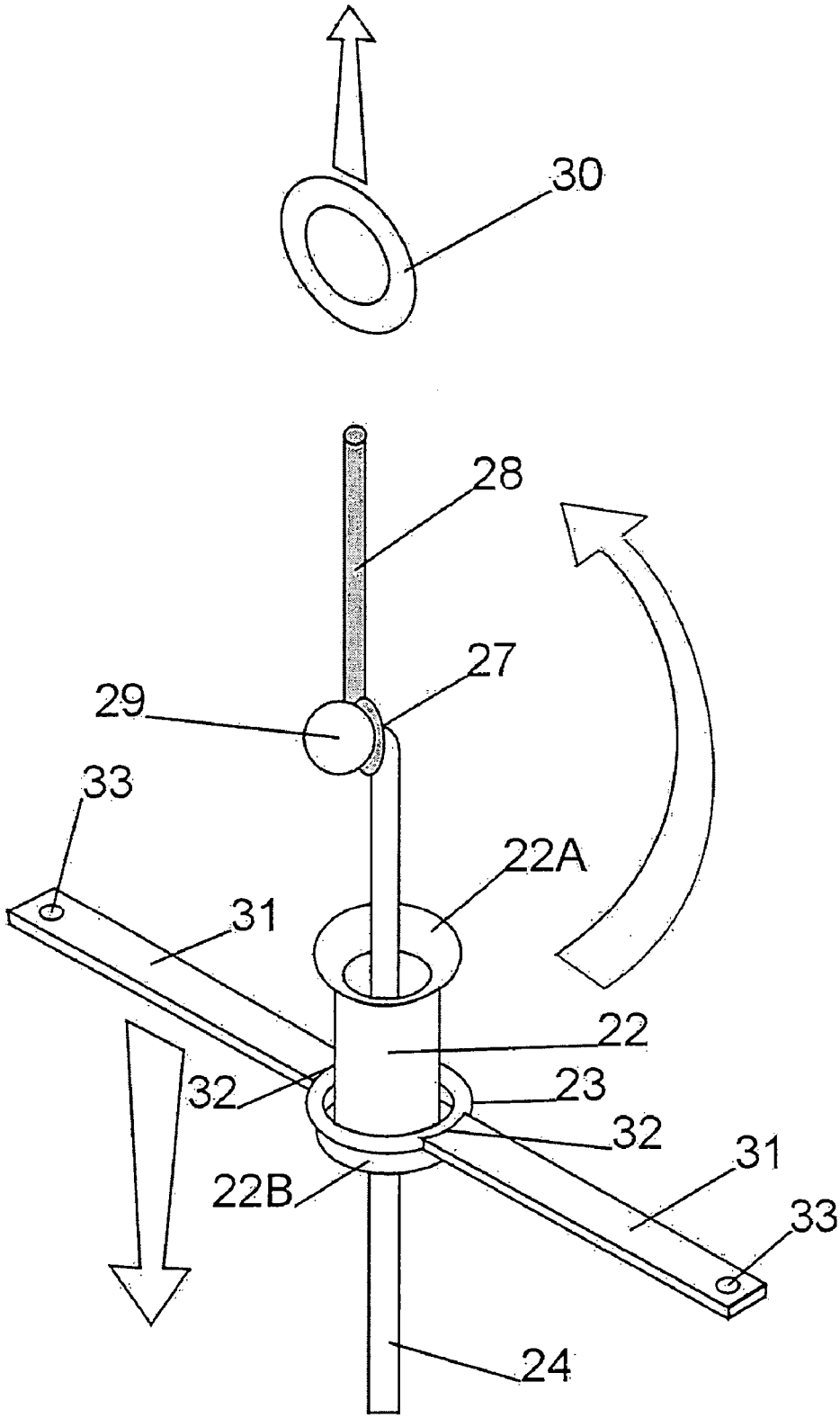

The cast-off device 21, represented in detail in FIGS. 1, 4 and 5, comprises a bi-conical sleeve 22 equipped with an actuating ring 23 mounted coaxially floating between two shoulders 22A, 22B forming the ends of the sleeve 22. A link cord 24 with a length of about less than one meter, has at its bottom end an attachment loop 25 designed to be fixed to the user, and is connected to the cast-off device 21 at its top end. The cord 24 passes through a hole 26 drilled in the centre of the piloting control bar 20.

The rear left control and right control lines 6B of the kite are affixed to each end of this bar 20. During different manoeuvres, the pilot is called on the make the control bar 20 make complete rotations around the cord 24. Likewise, also for control purposes, he regularly makes this bar slide along the cord 24 over all or part of its length. At its top end, the cord 24 passes through the loop 27 of a needle 28, in particular a metallic needle. In order to remain fixedly secured to the loop 27, the cord 24 is terminated by a knot 29.

The needle 28 is folded onto a pull-ring 30 whereto the front lines 6A of the wing 1 are connected. The cord 24 runs through the tubular sleeve 22 which acts as holding member for keeping the needle 28 in the folded position. The knot 29 constitutes a stop in this position and the actuating ring 23 is arranged coaxially around the sleeve 22 so as to be able to turn and slide freely between the two shoulders 22A, 22B.

Two gripping parts 31, in particular made from webbing or any other suitable element, are securedly affixed to the pull-ring 23 by folds 32. By this arrangement, any movement on the gripping part 31 exerted in translation downwards along the cord 24 (arrow F, FIG. 5) moves the sleeve 22 in the same direction and releases the needle 28 beyond a predetermined travel.

A pair of holes 33 are provided in the gripping parts 31 at the opposite ends for the rear lines 6B to pass through. The developed length of the gripping parts 31 corresponds substantially to the length of the piloting control bar 20. This arrangement enables both movement of the control bar 20 in translation without actuating the gripping parts 31 due to the holes 33, and free rotation of the control bar 20 around the cord 24 driving therewith the control lines 6B and the gripping parts 31 without exerting any force on the sleeve 22.

In order to avoid any involuntary actuation, a flexible stop disk 34 is arranged on the cord 24 in such a way as to come up against the stop formed by the shoulder 22B of the sleeve 22 in the blocking position of the needle 28 (FIG. 1). The stop disk 34 can be made from a resistant flexible plastic material, in particular polyurethane. When the pilot performs a deliberate command on a gripping part 31, the flexible stop disk 34 will deform to take the shape of the internal diameter of the sleeve 22. This deformation of the disk 34 then causes the needle 28 and pull-ring 30 to be released, followed by cast-off of the carrying front lines 6A. This results h instantaneous safety for the pilot in a situation where he has lost control of his wing. The speed with which this safety is achieved depends on the speed with which the user actuates his cast-off device 21.

For ease of resetting of the cast-off device 21 after actuation thereof, a recovery strap (not shown) can be arranged at a suitable height parallel to the gripping parts 31 above the pull-ring 30. Pull lines run through the centre of this recovery strap to enable recovery of the pull-ring 30 that was released upwards when a cast-off was performed.

Figure 6:
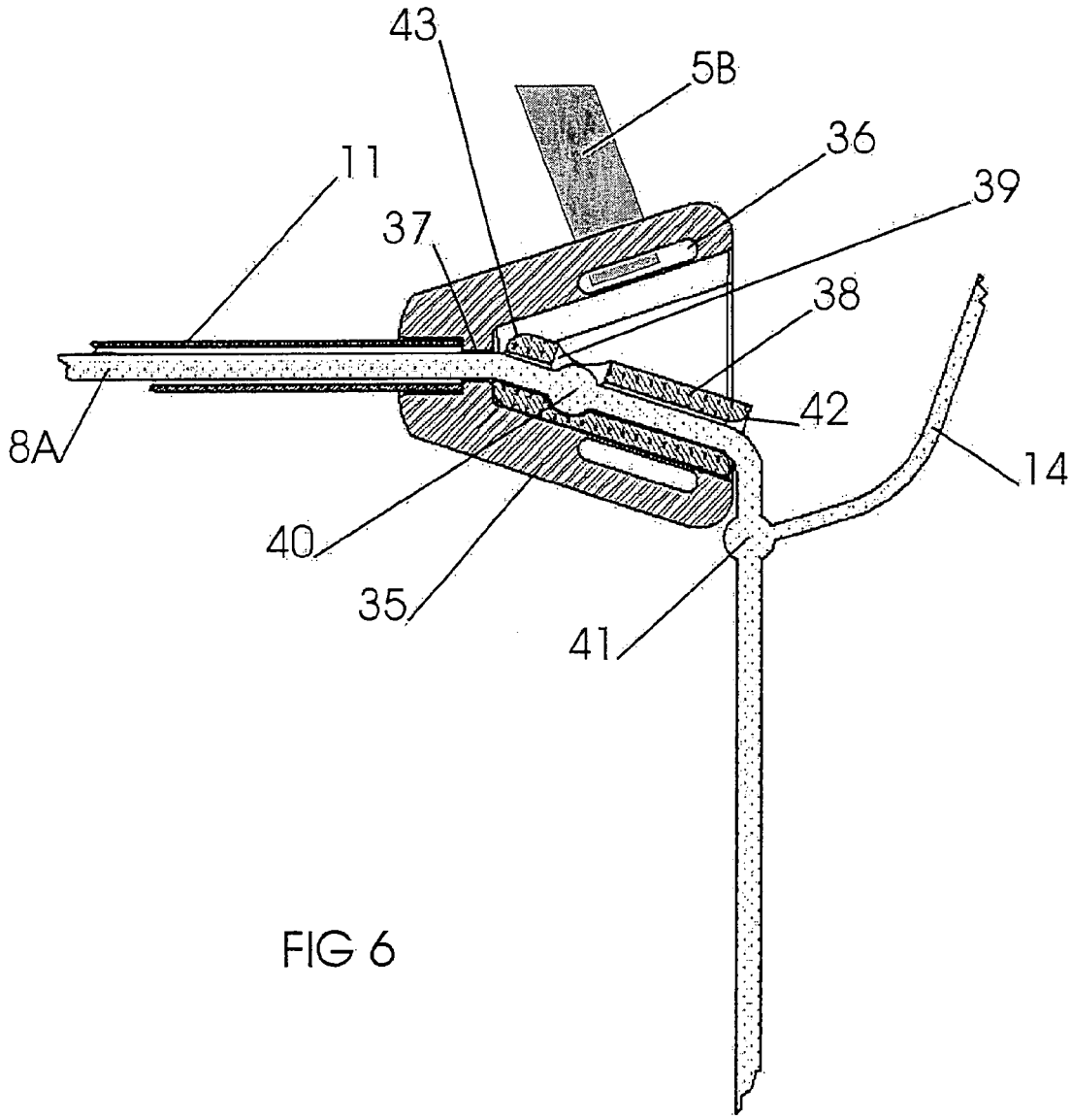
FIGS. 6 and 7 show cross-sectional views of an alternative embodiment of FIG. 2, respectively in the normal position in flight and in a disengaged position for safety purposes.
Figure 7:
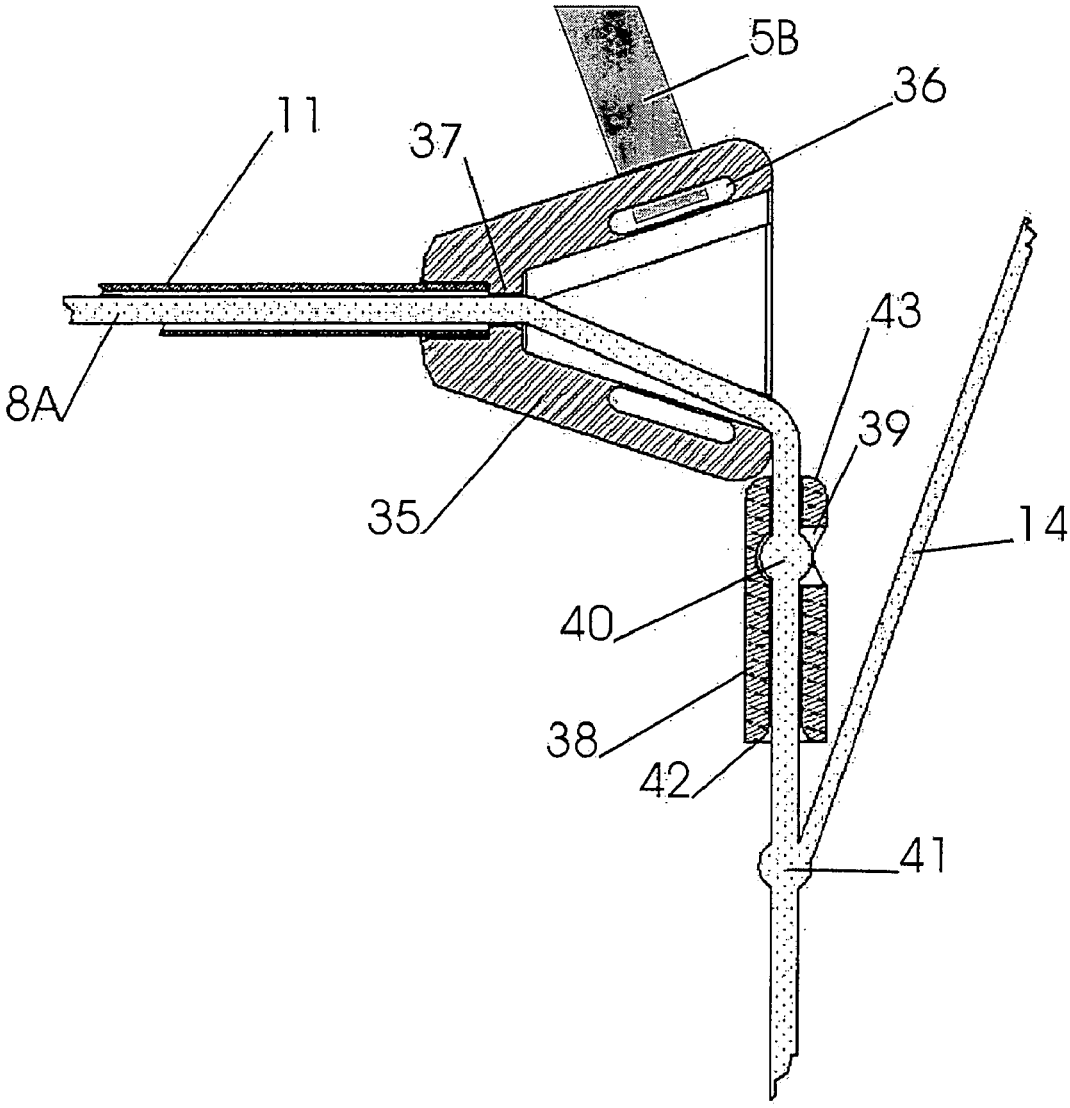

With reference to FIGS. 6 and 7, the pre-line 8A is continuous from front to rear up to the stop parts, and the link 9B of the rear attachment 5B of FIGS. 2 and 3 is replaced by a conical end-piece 35. The end-piece 35 is securedly attached to the wing 1 by the rear attachment 5B, which is formed for example by a sewn webbing passing through a slit 36 arranged in the moulded body of the end-piece 35.

The pre-line 8A passes through a hole 37 of suitable diameter made in the conical end-piece 35, and is equipped with a guide sleeve 38 designed to enter the inside of the end-piece 35. The sleeve 38 presents a substantially cylindrical shape and comprises a housing 39 wherein a first knot 40 of the line 8A engages. This knot 40 corresponds to the connection 13 of FIGS. 2 and 3. A second knot 41 is located substantially near to the rear end of the sleeve 38 and secures the rear re-launch line 14 to the sliding main line 8A.

The inside rear edge 42 of the sleeve 38 is advantageously conical in order to avoid cutting the line 8A in tension. The outside rear edge 43 of the sleeve 38 is bevelled to facilitate engagement thereof in the conical end-piece 35 when the line moves from the position of FIG. 7 to that of FIG. 6. The conical internal structure of the end-piece 35 is chosen to provide resistance to backward sliding of the line when a larger tension is applied on the rear strand than on the front strand. The end of the stiffening member 11 is fixed in the hole 37 of the end-piece 35 opposite the sleeve 38.

Beyond a certain tension differential on the ends of the line 8A, the sleeve 38 comes out of the end-piece 35 (FIG. 7) following sliding of the line 8A, at the same time bringing the re-launch line 14 with it, which ensures safety of the wing 1 by stopping the flight.

When the tension towards the front of the line 8A is greater than the tension towards the rear, the sleeve 38 enters the end-piece 35 and comes up against the stop formed by the inside front face of the cone (FIG. 6).

The invention claimed is:

1. A control and safety device for a power kite wing, the power kite wing having a leading edge arranged at the front tips of each side of the kite and a trailing edge extending at the rear tips of each side of the kite, said control and safety device comprising:

a front attachment comprising a first sliding device arranged at each front tip, a rear attachment comprising a second sliding device arranged at each rear tip, control lines comprising (i) a sliding pre-line having a first end extending from the first sliding device of the front attachment, and a second end extending from the second sliding device of the rear attachment, (ii) a portion of a front line extending from the first end of the pre-line, and (iii) a portion of a rear line extending from the second end of the pre-line, a control device operating in conjunction with the portions of front line and rear line to guide the kite, and a stiffening member that maintains a predetermined distance between the front and rear attachments.

2. The device according to claim 1, wherein the sliding pre-line comprises stops that limit movement of the sliding pre-line when a traction is applied in one direction or the other.

3. The device according to claim 2, wherein the stops are formed by two front and intermediate connections coming into engagement with the first and second sliding devices.

4. The device according to claim 1, further comprising a re-launch line extending between the rear line and a trailing edge of the kite wing.

5. The device according to claim 4, wherein the re-launch line is connected to the sliding pre-line and to one or more connections of slats on a trailing edge side of the slats.

6. The device according to claim 1, wherein the stiffening member is hollow, and that the sliding pre-line passes therethrough.

7. The device according to claim 6, wherein the stiffening member further comprises two end-pieces forming stops against the first and second sliding devices.

8. The device according to claim 1, wherein the first and second sliding devices of the pre-line are formed by first and second sliding links fixed to the front and rear attachments.

9. The device according to claim 1, wherein the second sliding device of the rear attachment comprises a conical end-piece operating in conjunction with a sleeve securedly attached to the pre-line.

10. The device according to claim 9, wherein the sleeve comprises a housing for receiving a first knot of the pre-line.

11. The device according to claim 10, wherein the pre-line comprises a second knot at the rear of the sleeve and connected to a re-launch line.

12. The device according to claim 1, wherein the control device comprises a control bar connected to the rear line, and a cast-off device comprising an actuating unit associated with a pull-ring connected to the front line.

13. The device according to claim 12, wherein the actuating unit of the cast-off device comprises a link cord for connecting to an attachment loop and a tubular sleeve on which an actuating ring is coaxially mounted.

14. The device according to claim 13, wherein the actuating ring comprises at least one gripping part in connection with a rear line connected to the control bar to enable movement of the control bar in translation and in rotation with respect to the link cord passing through the tubular sleeve.

15. The device according to claim 13, wherein the link cord comprises a needle securing the pull-ring in the loaded position, and a flexible stop disk to (1) keep the tubular sleeve in the loaded position during normal use of the kite, and (2) enable the needle to escape by movement of the tubular sleeve to the actuated position following translation of the gripping part.

16. A power kite wing comprising the device of claim 1.

17. A power kite wing comprising the device of claim 4.

18. A power kite wing comprising the device of claim 9.

19. A power kite wing coompising the device of claim 12.

* * * * *